US007452158B1

(12) United States Patent
Siu

(10) Patent No.: US 7,452,158 B1
(45) Date of Patent: Nov. 18, 2008

(54) INFILL FOR BOLLARD FOOTING HOLE

(75) Inventor: Kin Wai Michael Siu, Kowloon (HK)

(73) Assignee: Hong Kong Polytechnic University, The, Kowloon (HK)

( * ) Notice: Subject to any disclaimer, the term of this patent is extended or adjusted under 35 U.S.C. 154(b) by 0 days.

(21) Appl. No.: 11/806,692

(22) Filed: Jun. 4, 2007

(51) Int. Cl.
*E01F 9/011* (2006.01)
*E01F 9/013* (2006.01)

(52) U.S. Cl. ..... 404/11; 404/10

(58) Field of Classification Search ..... 404/6, 404/9, 11, 10
See application file for complete search history.

(56) References Cited

U.S. PATENT DOCUMENTS 5,192,159 A * 3/1993 Higginson ..... 404/11
5,462,384 A * 10/1995 Arlandis ..... 404/6
5,476,338 A * 12/1995 Alberts ..... 404/6
5,899,628 A * 5/1999 Pei-Chi ..... 404/9

* cited by examiner

*Primary Examiner*—Raymond W Addie
(74) *Attorney, Agent, or Firm*—Stephen M. De Klerk; Sonnenschein, Nath & Rosenthal LLP

(57) ABSTRACT

The invention relates to an infill which can be inserted into a bollard footing hole. The infill is designed such that it allows a bollard to be fit over it, and the infill fits within a footing hole. Methods of covering a footing hole are also bought.

10 Claims, 4 Drawing Sheets

INFILL FOR BOLLARD FOOTING HOLE

BACKGROUND

A bollard is a short vertical post. Bollards, such as posts, poles, columns and bars, are commonly used in urban areas as well as other public environments for more flexible applications. Bollards are often removable, allowing a bollard to be positioned or not when designing traffic control. However, when removable, a footing hole appears on the ground when a bollard is removed. The hole causes dangerous situations for people, and traps rubbish and creates inconvenience for inserting the bollard into the footing hole. To address this and cover the hole, a cap is attached to the ground or the footing hole housing. The cap covers the hole when a bollard is removed. However, the cap is flipped up when the bollard is inserted in the hole. The cap may then be inconvenient or even dangerous.

In other case, some people use additional devices or objects to cover the holes. However, such additional infills require additional space for storage and they are inconvenient for handling.

It is a goal of the present invention to cover a bollard footing hole with an infill and overcome the disadvantages and problems in the prior art.

DESCRIPTION

The present invention proposes an infill which can be inserted into a bollard footing hole no matter if a bollard is inserted in the hole or not, such infill being able to cover the hole while avoiding hazardous or dangerous situations.

The present invention also proposes covering a footing hole housing by using an infill that is capable of being overturned and repositioned in the footing hole housing.

These and other features, aspects, and advantages of the apparatus and methods of the present invention will become better understood from the following description, appended claims, and accompanying drawings where:

The following description of certain exemplary embodiment(s) is merely exemplary in nature and is in no way intended to limit the invention, its application, or uses. Throughout this description, the term "footing hole" refers to a footing hole with or without a footing hole housing.

Now, to FIGS. 1-4,

The present invention is related to an infill which can be inserted into a footing hole along with a hollow bollard. The present invention also focuses on a method for covering a footing hole utilizing an infill.

Figure 1:
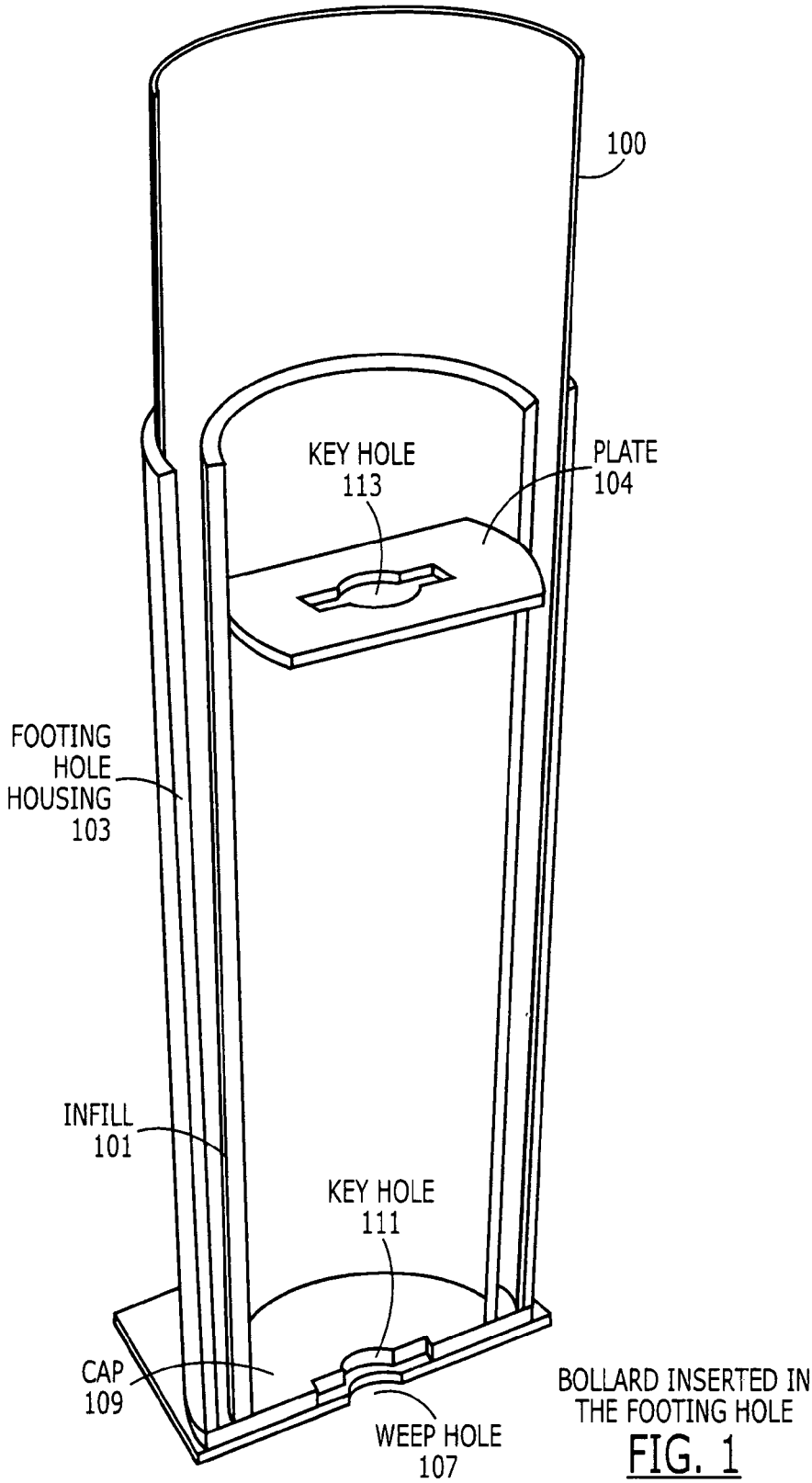
FIG. 1 shows cross-sectional three dimensional view of the infill positioned in the footing hole housing with the bollard positioned thereon.

FIG. 1 shows an embodiment of the cross-sectional three dimensional view of infill 101 apparatus of the present invention. Included with the infill 101, are the footing hole housing 103 and a removable bollard 100.

The infill 101, as inserted as show in FIG. 1, includes the cap 109.

Inside the infill 101, there is a plate 104 with a key hole 113 at the centre of the plate 104. The key hole 113 is for a key (in T shape) to be put in for pulling out the infill 101 from the footing hole housing 103 easily.

At another part of the infill 101, a key hole 111 is centered. At the same end of the infill 101 as the key hole 111, a cap 109 is positioned. The cap 109 has a diameter that is larger than the diameter of the infill 101.

Internally, the infill 101 can be hollow or solid. Preferably, the infill 101 is hollow, allowing the infill 101 to be light weight and easily movable. The cross section of the infill 101 can be a form such as a circle, square, rectangle, hexagon, or octagon.

The diameter of the infill 101 excluding the cap 109 is smaller than the diameter of the bollard 100. This is to allow the bollard 100 to be placed over the infill 100. The height or length of the infill 101 (including the cap 109) is preferably the same as the internal length or depth of the footing hole housing 103.

As will be discussed later, the cap 109 of the infill 101 includes non-slip means such as troughs, slots, grooves, trenches, patterns, non-slippery texture, and the like.

Below the infill 101, is a weep hole 107 in the footing hole housing 103. The weep hole 107 is provided to extract water, and foreign substances such as dirt.

Figure 2:
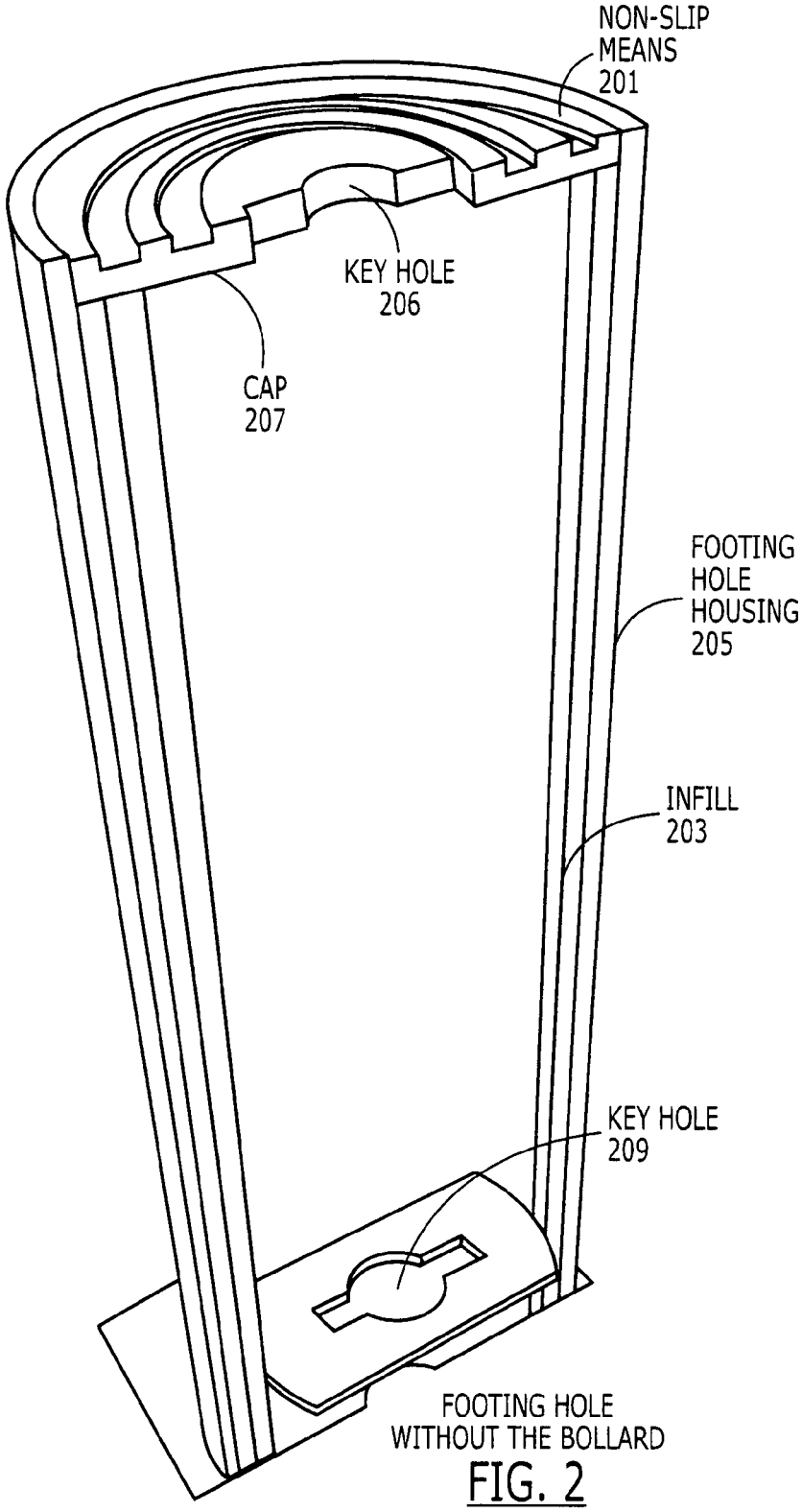
FIG. 2 shows the cross-sectional three dimensional view of the infill positioned in the footing hole housing such that it positions its cover over the footing hole housing.

FIG. 2 is an embodiment of the cross-sectional three dimensional view of the infill 203 positioned as a hole covering for a footing hole housing 205.

As shown in the embodiment, the cap 207 of infill 203 is positioned topside. In this position, the non-slip means 201 assist pedestrians in not being injured if they step on the cap 207. When the cap 207 is topside, the open end of the infill 203 is facing downward.

A key hole 206 is at the center of the cap 207. The key hole 206 is for a key (in T shape) to be put in for pulling out the infill 203 from the footing hole housing 205 easily. The diameter of the cap 207 is same as or slightly smaller that the internal diameter of the footing hole housing 205.

Figure 3:
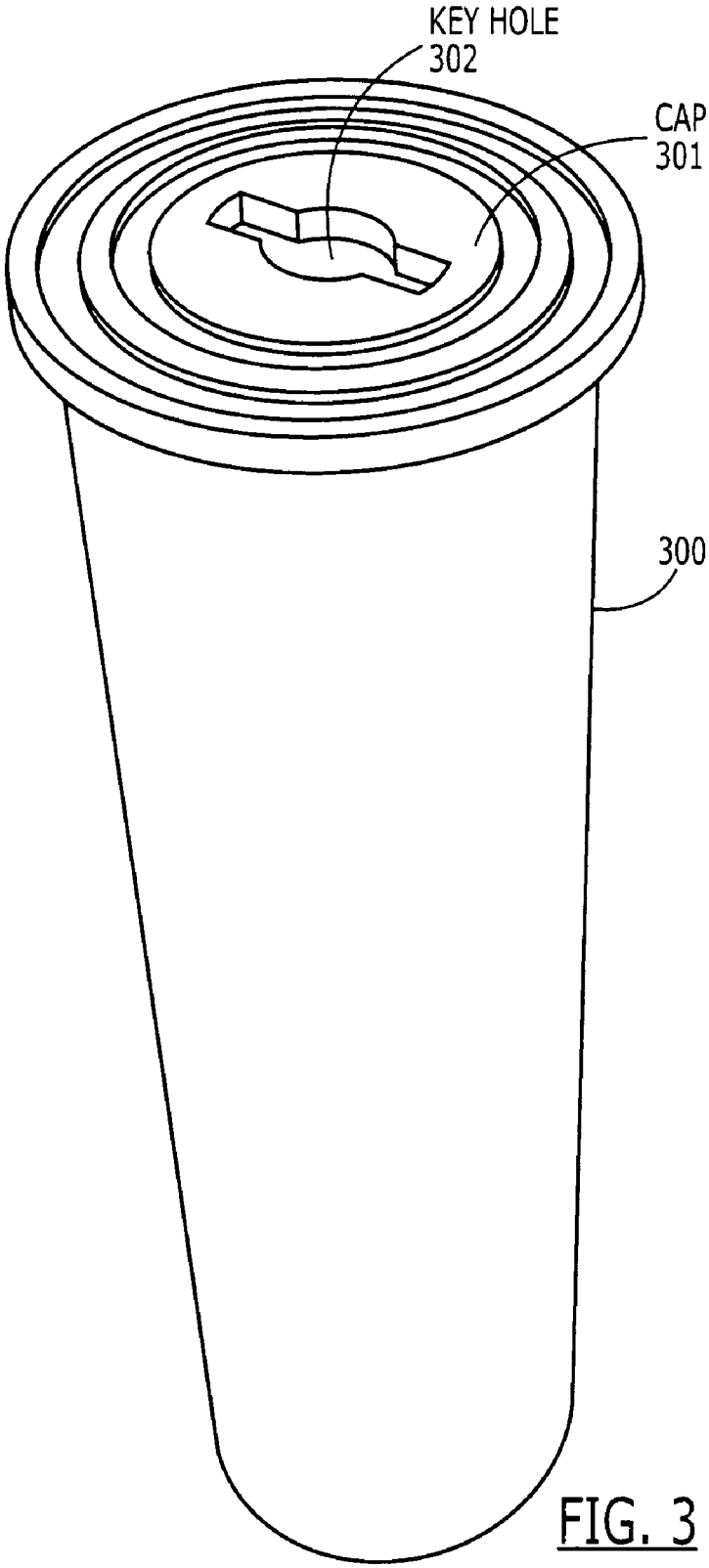
FIG. 3 shows an embodiment of the infill in a three dimensional view.

FIG. 3 shows the three dimensional view of the infill 300, wherein the cap 301 of the infill is topside. As shown, the key hole 302 is at the center of the cap 301.

Figure 4:
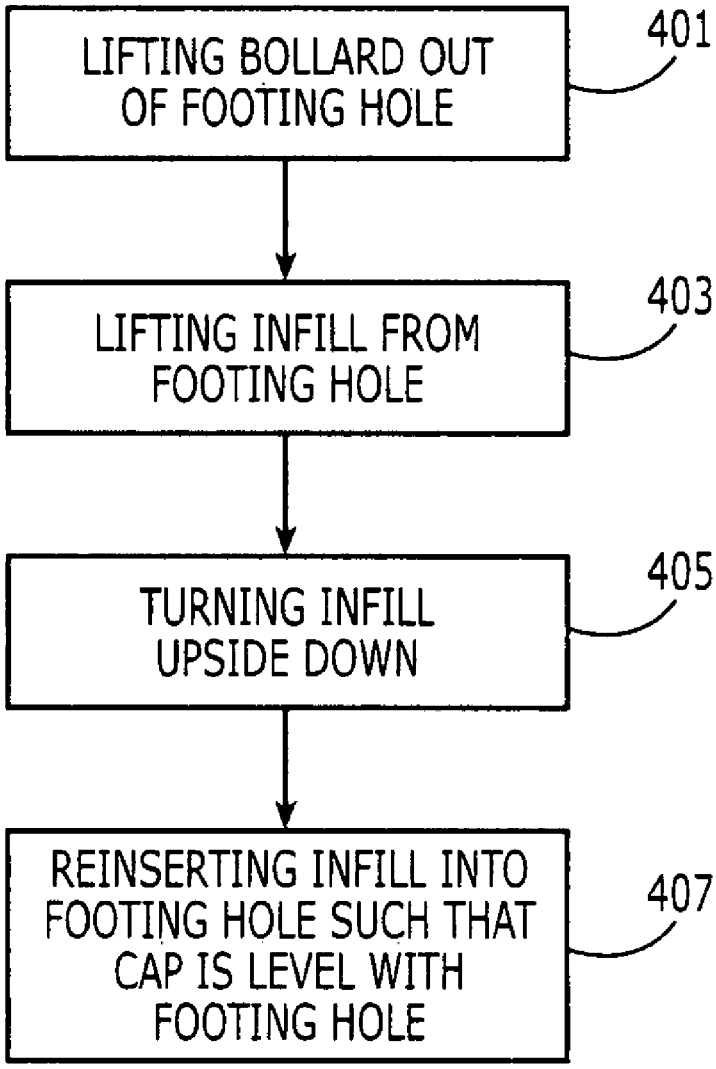
FIG. 4 shows a method of covering a footing hole housing with an infill.

FIG. 4 shows an embodiment of the method of covering a footing hole utilizing the infill apparatus of the present invention. The steps include lifting the bollard out of the footing hole 401. The bollard should be hollow in order to incorporate the infill within the bollard. As shown previously (FIG. 1), the diameter of the bollard should be less than diameter of footing hole, allowing the bollard's sides to fit with the footing hole. Following, the infill was lifted from footing hole 403. The infill can be lifted via a hole, key hole, or handle. Preferably, a key hole is positioned at the center of the infill. After being lifted from the footing hole, the infill is turned upside down 405 or turned such that the cap of the infill is topside. In another embodiment, if the footing hole is at any angle from a horizontal ground to a vertical wall, the infill will be removal and rotated such that the cap of the infill is outside the footing hole.

After rotating the infill, the infill is reinserted into the footing hole 407. The infill will be reinserted such that the cap is outside the footing hole. When fully inserted, the top of the cap is at the same horizontal level of the ground level.

Having described embodiments of the present system with reference to the accompanying drawings, it is to be understood that the present system is not limited to the precise embodiments, and that various changes and modifications may be effected therein by one having ordinary skill in the art without departing from the scope or spirit as defined in the appended claims.

In interpreting the appended claims, it should be understood that:

a) the word "comprising" does not exclude the presence of other elements or acts than those listed in the given claim;

b) the word "a" or "an" preceding an element does not exclude the presence of a plurality of such elements;

c) any reference signs in the claims do not limit their scope;

d) any of the disclosed devices or portions thereof may be combined together or separated into further portions unless specifically stated otherwise; and e) no specific sequence of acts or steps is intended to be required unless specifically indicated.

The invention claimed is:

1. A footing hole infill comprising a plate inside said infill having a key hole on said plate; and a cap having a key hole positioned thereon and having a non-slip means; wherein the diameter of the infill is smaller than a corresponding bollard.

2. The footing hole infill in claim 1, wherein said infill has a cross section in the form of a circle, square, rectangle, hexagon, or octagon.

3. The footing hole infill in claim 2, wherein said cap of said infill has a diameter that is larger than the infill body external diameter.

4. A bollard system, comprising a removable infill having an external diameter smaller than the internal diameter of the bollard;

a removable bollard having an external diameter smaller than a footing hole, but the removable bollard has an internal diameter larger than the external diameter of said removable infill;

and a footing hole.

5. The bollard system in claim 4, wherein said removable infill is comprised of a body, and a cap, wherein a keyhole is positioned at either ends of a plate inside infill body and cap.

6. The bollard system in claim 4, further comprising a weep hole on the bottom of said footing hole.

7. The bollard system in claim 5, wherein said cap further comprises a non-slip means.

8. The bollard system in claim 5, wherein said cap has a diameter equal to or slightly smaller than the bollard's external diameter.

9. A method of covering a footing hole comprising the steps of lifting a bollard out of a footing hole;

lifting an infill from said footing hole;

rotating said infill such that the infill's cap is on the opposite side from when it was inside said footing hole; and reinserting said infill, wherein reinstating said infill into said footing hole proceeds until the cap of said infill is equal level with the footing hole.

10. The method of covering said footing hole in claim 9, wherein lifting said infill occurs via a hole, keyhole, or handle.

* * * * *